US011044988B2

(12) United States Patent
Tao et al.

(10) Patent No.: US 11,044,988 B2
(45) **Date of Patent: *Jun. 29, 2021**

(54) FOLDING TABLE

(71) Applicant: Changzhou Tsr Gas Spring Co., Ltd., Changzhou (CN)

(72) Inventors: Shengrong Tao, Changzhou (CN); Xiaogang Li, Changzhou (CN)

(73) Assignee: Changzhou Tsr Gas Spring Co., Ltd., Changzhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/882,771

(22) Filed: May 26, 2020

(65) Prior Publication Data

US 2021/0068531 A1 Mar. 11, 2021

(30) Foreign Application Priority Data

Sep. 6, 2019 (CN) ..... 201910839808.1

(51) Int. Cl.

| | |
|---|---|
| ***A47B 3/083*** | (2006.01) |
| ***A47B 3/08*** | (2006.01) |
| ***A47B 13/00*** | (2006.01) |
| ***A47B 13/02*** | (2006.01) |
| *A47B 3/00* | (2006.01) |

(52) U.S. Cl.

CPC ..... *A47B 3/083* (2013.01); *A47B 3/0818* (2013.01); *A47B 13/003* (2013.01); *A47B 13/023* (2013.01); *A47B 3/002* (2013.01)

(58) Field of Classification Search

CPC ..... A47B 3/00; A47B 3/002; A47B 3/0803; A47B 3/08; A47B 3/0818

USPC ..... 108/115

See application file for complete search history.

(56) References Cited

U.S. PATENT DOCUMENTS

| | | | | | |
|---|---|---|---|---|---|
| 120,550 | A * | 10/1871 | Thorton | A47B 13/023 | 108/6 |
| 2,567,593 | A * | 9/1951 | Bemis | A47B 3/0818 | 108/4 |
| 6,192,808 | B1 * | 2/2001 | Bue | A47B 3/0911 | 108/1 |
| 7,066,098 | B2 * | 6/2006 | Blasen | A47B 3/08 | 108/115 |
| 8,272,336 | B2 * | 9/2012 | Rutz | A47B 3/08 | 108/115 |
| 8,297,207 | B2 * | 10/2012 | Liu | A47B 13/021 | 108/115 |

(Continued)

FOREIGN PATENT DOCUMENTS

| | | | | |
|---|---|---|---|---|
| CA | 3021402 | A1 * | 4/2019 | A47B 13/081 |
| CN | 103126300 | A | 6/2013 | |

*Primary Examiner* — Jose V Chen

(74) *Attorney, Agent, or Firm* — Bayramoglu Law Offices LLC

(57) ABSTRACT

A folding table, including a table top, a table leg and a first hanged lock for locking the table leg and the table top after the table leg and the table top rotate relative to each other, wherein one end of the first hanged lock is connected with the table top, and the other end of the first hanged lock is connected with the table leg; and the table leg or the table top rotates relative to each other in an unlocked state, the first hinged lock locks the table leg and the table top after an included angle formed between the table leg and the table top is one of 0-90°.

11 Claims, 12 Drawing Sheets

(56) References Cited

U.S. PATENT DOCUMENTS

| | | | | |
|---|---|---|---|---|
| 8,539,888 | B2 * | 9/2013 | Hernandez | A47B 85/06 108/115 |
| 8,539,889 | B1 * | 9/2013 | Khalaf Allah | A47B 85/06 108/115 |
| 8,661,990 | B2 * | 3/2014 | Crowe | A47C 7/70 108/115 |
| 10,206,494 | B1 * | 2/2019 | Gretscher | A47B 3/0818 |
| 2003/0056699 | A1 * | 3/2003 | Malizia | A47C 4/08 108/115 |
| 2006/0185566 | A1 * | 8/2006 | Mangano | A47B 87/002 108/115 |
| 2007/0095257 | A1 * | 5/2007 | Hernandez | A47B 3/0815 108/115 |
| 2007/0234934 | A1 * | 10/2007 | Branch | A47B 23/046 108/115 |
| 2010/0231102 | A1 * | 9/2010 | Block | A47B 21/0314 312/249.8 |
| 2010/0258042 | A1 * | 10/2010 | Rutz | A47B 3/0818 108/115 |
| 2019/0142153 | A1 * | 5/2019 | Zunkeler | A47B 13/06 108/13 |
| 2019/0365091 | A1 * | 12/2019 | Ruzicka | A47B 13/081 |
| 2020/0367639 | A1 * | 11/2020 | Bonato | A47B 7/02 |

* cited by examiner

FOLDING TABLE

CROSS REFERENCES TO THE RELATED APPLICATIONS

This application is based upon and claims priority to Chinese Patent Application No. 201910839808.1, filed on Sep. 6, 2019, the entire contents of which are incorporated herein by reference.

TECHNICAL FIELD

The present invention relates to a folding table.

BACKGROUND

An office table is usually composed of a table top, table legs and a grounded part. One ends of the table legs are connected with the table top, and the other ends of the table legs are connected with the grounded part. CN103126300 A discloses a folding table, of which a table top and table legs are connected through a folding mechanism, so that the table top can be folded 90° relative to the table legs.

For the folding table with the above structure, although the table top can be rotated relative to the table legs, after rotation, the axial direction of the table top is either parallel to the axial direction of the table legs or perpendicular to the axial direction of the table legs, and the table top cannot be fixed within a 90° range of rotation. For example, when the table top is rotated for 30° relative to the table legs to enable the table top to be in a tilted state and a user needs to use the table top at this inclination angle, the table top cannot be fixed at this inclination angle. Therefore, the user cannot use the table top in a required tilted state.

In addition, for the folding table with the above structure, the table legs and the grounded part are fixedly connected, that is, the table legs and the grounded part cannot be folded, so that the folding table occupies space during transportation or carrying, resulting in inconvenient transportation or carrying.

SUMMARY

The present invention provides a folding table capable of locking a table top and a table leg at an included angle of one of 0 to 90° after the table top and the table leg rotate relative to each other.

The technical scheme for solving the above technical problems is as follows:

A folding table includes:

a table top;

a table leg for supporting the table top; and a first hinged lock for locking the table leg and the table top after the table leg and the table top rotate relative to each other, wherein one end of the first hinged lock is connected with the table top, and the other end of the first hinged lock is connected with the table leg; and the table leg or the table top rotates relative to each other in an unlocked state, the first hinged lock locks the table leg and the table top at an included angle of one of 0 to 90°, and then one end of the first hinged lock keeps the connection with the table top, and the other end of the first hinged lock keeps the connection with the table leg so as to limit the rotation of the table top and the table leg relative to each other.

The present invention has the advantage that when the table top and the table leg are in a folded state relative to each other, a user can set the included angle formed between the table top and the table leg to be one of 0 to 90° and limit the rotation of the table top and the table leg relative to each other. The folding table with this structure has the following application scenes: when the user sets the included angle formed between the table top and the table leg to be 45°, one end of a drawing board is hung on the table top for drawing. For another example, when the user sets the included angle formed between the table top and the table leg to be 0°, a tablet computer or display is fixed on the table top for watching videos. For another example, when the user sets the included angle formed between the table top and the table leg to be 10°, paper is fixed on the table top for writing. Therefore, the user can control the included angle formed between the table top and the table leg according to needs, and maintain the positioning of the table top and the table leg at this included angle, so that the user can perform a specific operation. In conclusion, the structure of the present invention has the advantage of widening the range of application.

Figure 1:
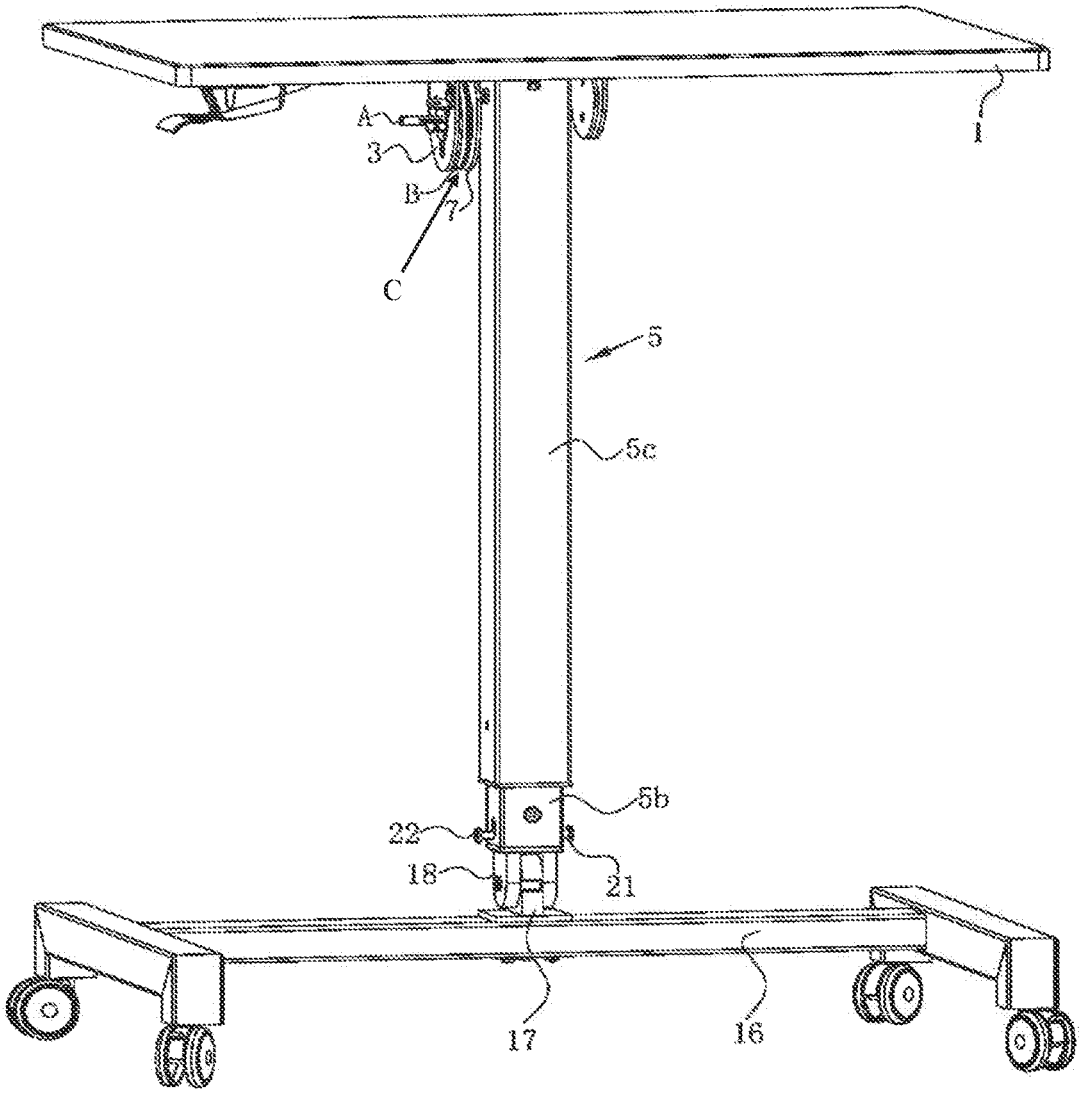
FIG. 1 is a schematic diagram when an included angle between a table top and a table leg of a single-table-leg folding table is locked at 90°, and an included angle between the table leg and a grounded part is locked at 90°.

Reference numerals in FIG. 1 to FIG. 18 are as follows:

A denotes a handle; B denotes a ring sleeve; C denotes a first hinged lock; D denotes a containing cavity; E denotes a transmission component; F denotes first gear teeth;

1 denotes a table top body; 2 denotes a first top; 3 denotes a first lug; 3*a* denotes a first assembly hole; 3*b* denotes a first shaft hole; 4 denotes a second lug; 4*a* denotes an arc-shaped groove; 4*b* denotes a hole; 5 denotes a table leg body; 5*a* denotes a lifting air pressure bar; 5*b* denotes an inner sleeve; 5*c* denotes an outer sleeve; 6 denotes a second top; 7 denotes a third lug; 7*a* denotes a first mounting hole; 8 denotes a fourth lug; 8*a* denotes a guide pin; 8*b* denotes a hinged shaft; 9 denotes a first housing; 9*a* denotes a first circumferential positioning part; 9*b* denotes a first hole; 9*c* denotes a second hole; 9*d* denotes a guide block; 9*e* denotes a guide groove; 9*f* denotes an inserting hole; 9*g* denotes a first groove; 10 denotes a lock block; 10*a* denotes a protrusion; 10*b* denotes a second gear teeth; 11 denotes a transmission tray; 11*a* denotes a groove body; 12 denotes a second housing; 12*a* denotes a second circumferential positioning part; 13 denotes a transmission shaft; 14 denotes a scroll spring or torsion spring; 15 denotes a star wheel; 15*a* denotes an abutting part; 15*b* denotes a blocking part;

16 denotes a grounded part; 17 denotes a first connecting base; 17*a* denotes a groove; 18 denotes a second connecting base; 18*a* denotes a first assembly hole; 18*b* denotes a second assembly hole; 18*c* denotes a fixed part; 18*d* denotes a hinged part; 19 denotes an elastic component; 20 denotes a tongue part; 21 denotes a rod part; 21*a* denotes a first flange; 22 denotes a connecting component; 22*a* denotes a second flange; 23 denotes a slide block; 24 denotes an electric motor; 25 denotes a first linear transmission component; and 26 denotes a second linear transmission component.

DETAILED DESCRIPTION OF THE EMBODIMENTS

Embodiment I

As shown in FIG. 1, a folding table of the present invention includes a table top, a table leg for supporting the table top, and a first hinged lock C for enabling the table leg or the table top to rotate relative to each other in an unlocked state. All parts and the relationship thereof are described in detail below.

Figure 2:
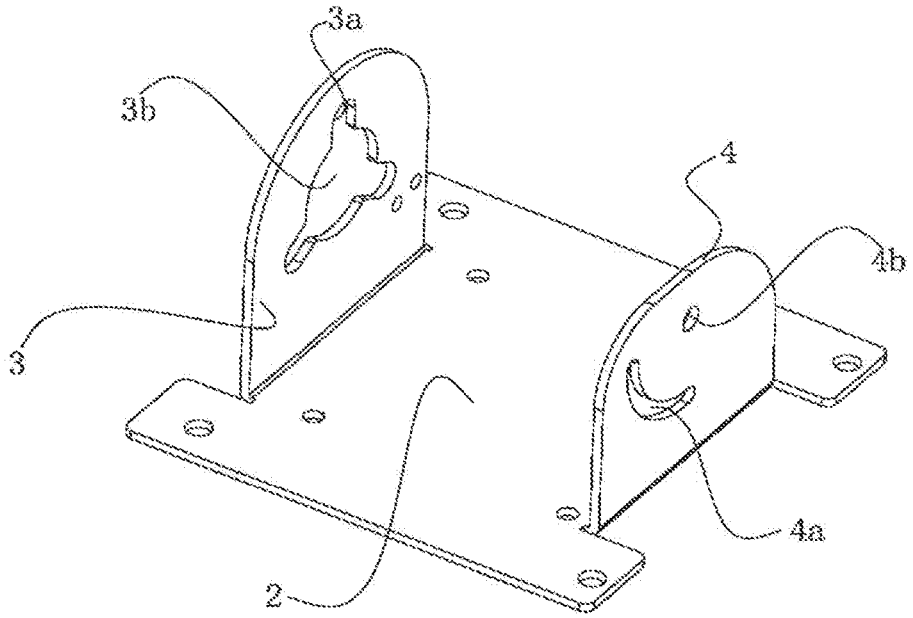
FIG. 2 is a schematic diagram of a first bracket.

As shown in FIG. 1 to FIG. 2, the table top includes a table top body 1 and a first bracket. The first bracket includes a first top 2 fixed to the table top body 1 and a first lug 3 connected with one end of the first hinged lock C. The first top 2 is fixed to the table top body 1 through bolts. The first lug 3 is disposed at one end of the first top 2. A first included angle is formed between the first lug 3 and the first top 2, and the first included angle is preferably 90°. Preferably, the first top 2 is bent to form the first lug 3, so that the first included angle is formed between the first top 2 and the first lug 3.

As shown in FIG. 1 to FIG. 2, the first bracket further includes a second lug 4 hinged with the table leg, and the second lug 4 is disposed at the other end of the first top 2. A second included angle is formed between the second lug 4 and the first top 2, and the second included angle is preferably 90°. Preferably, the first top 2 is bent to form the second lug 4, so that the second included angle is formed between the first top 2 and the second lug 4. After the first lug 3 and the second lug 4 are respectively disposed at two ends of the first top 2, a cross section of the first bracket is in an inverted U shape.

Figure 3:
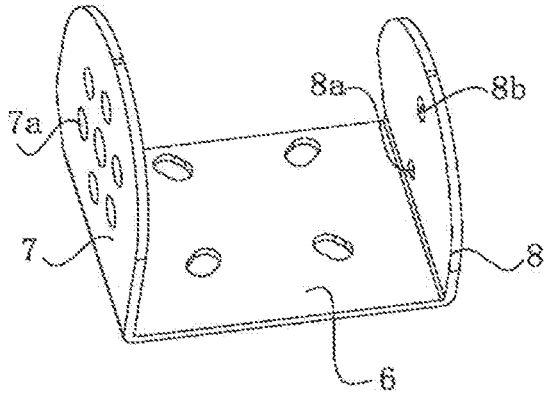
FIG. 3 is a schematic diagram of a second bracket.
Figure 4:
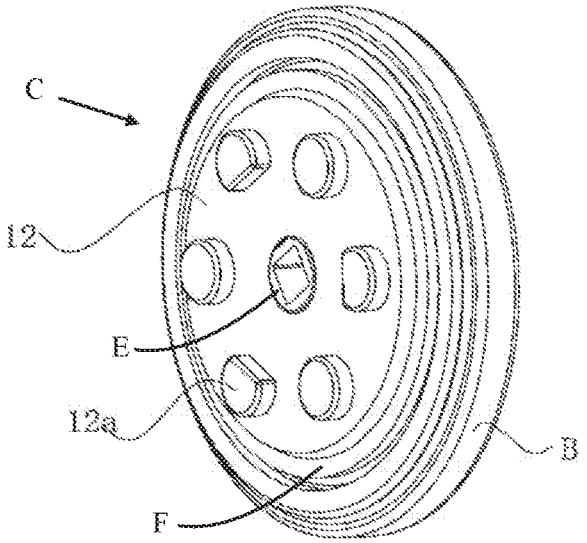
FIG. 4 is a three-dimensional diagram of a first hinged lock.
Figure 5:
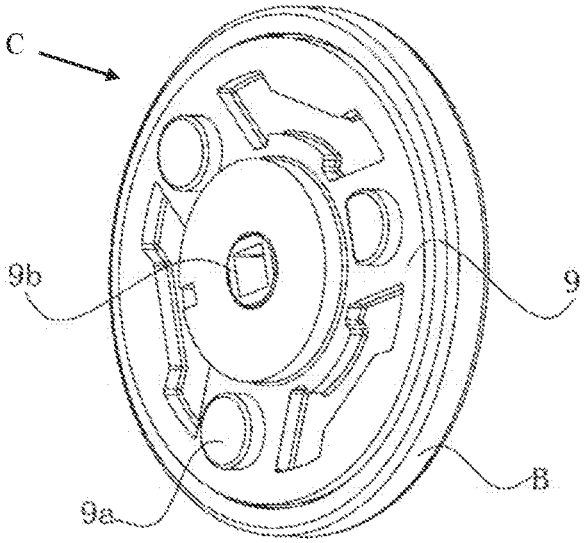
FIG. 5 is a three-dimensional diagram of the first hinged lock viewed from another direction.

As shown in FIG. 1 and FIG. 3, the table leg includes a table leg body 5 and a second bracket. The second bracket includes a second top 6 fixed to the table leg body and a third lug 7 connected with the other end of the first hinged lock C. The second top 6 is fixedly connected with the table leg body through screws. The third lug 7 is disposed at one end of the second top 6. A third included angle is formed between the third lug 7 and the second top 6, and the third included angle is preferably 90°. Preferably, the second top 6 is bent to form the third lug 7, so that the third included angle is formed between the second top 6 and the third lug 7.

As shown in FIG. 1 and FIG. 3, the second bracket further includes a fourth lug 8 hinged with the table top, and the fourth lug 8 is disposed at the other end of the second top 6. A fourth included angle is formed between the fourth lug 8 and the second top 6, and the fourth included angle is preferably 90°. Preferably, the second top 6 is bent to form the fourth lug 8, so that the fourth included angle is formed between the second top 6 and the fourth lug 8. After the third lug 7 and the fourth lug 8 are respectively disposed at two ends of the second top 6, a cross section of the second bracket is in an inverted U shape.

As shown in FIG. 1 and FIG. 3, the fourth lug 8 is hinged with the second lug 4. Preferably, an arc-shaped groove 4*a* and a hole 4*b* are disposed on the second lug 4. A guide pin 8*a* and a hinged shaft 8*b* are disposed on the fourth lug 8. The guide pin 8*a* is in clearance fit in the arc-shaped groove 4*a*. The hinged shaft 8*b* is in clearance fit in the hole 4*a*. The matching between the guide pin 8*a* and the arc-shaped groove 4*a* guides the first bracket and the second bracket when the first bracket and the second bracket rotate relative to each other.

As shown in FIG. 1 and FIG. 12 to FIG. 14, the first hinged lock C locks the table leg and the table top after the table leg and the table top rotate relative to each other. One end of the first hinged lock C is connected with the table top, and the other end of the first hinged lock C is connected with the table leg. The table leg or the table top rotates relative to each other in an unlocked state, the first hinged lock C locks the table leg and the table top at an included angle of one of 0 to 90°, and then one end of the first hinged lock C keeps the connection with the table top, and the other end of the first hinged lock C keeps the connection with the table leg so as to limit the rotation of the table top and the table leg relative to each other.

As shown in FIG. 1 to FIG. 3 and FIG. 4 to FIG. 8, one end of the first hinged lock C is connected with the first lug 3, and the other end of the first hinged lock C is connected with the second lug 7. The first hinged lock C includes a first housing 9 with a containing cavity D, a transmission component E, a lock block 10, a transmission tray 11, a second housing 12 and a ring sleeve B. The first hinged lock C is connected with the first lug 3 preferentially through the first housing 9, and the first hinged lock C is connected with the second lug 7 preferentially through the second housing 12. The preferred structure of the first hinged lock C is described below.

As shown in FIG. 1 to FIG. 3 and FIG. 4 to FIG. 8, preferably, a plurality of first assembly holes 3*a* are formed in the end surface of the first lug 3, and these first assembly holes 3*a* are uniformly distributed in the same circumference preferentially. A plurality of first circumferential positioning parts 9*a* are disposed on the end surface of the first housing 9, and after the first circumferential positioning parts 9*a* are matched with the first assembly holes 3*a*, the first housing 9 and the first lug 3 cannot rotate relative to each other.

As shown in FIG. 1 to FIG. 3 and FIG. 4 to FIG. 8, a first shaft hole 3*b* is formed in the end surface of the first lug 3. Preferably, the first shaft hole 3*b* is communicated with each first assembly hole 3*a*. When one end of a handle A is rotated to be connected with the transmission component E, the other end of the handle A passes through the first shaft hole 3*b* and is exposed to the air, so that a user can operate the handle A.

As shown in FIG. 1 to FIG. 3 and FIG. 4 to FIG. 8, a plurality of first mounting holes 7*a* are formed in the end surface of the second lug 7, and these first mounting holes 7*a* are uniformly distributed in the same circumference preferentially. A plurality of second circumferential positioning parts 12*a* are disposed on the end surface of the second housing 12, and after the second circumferential positioning parts 12*a* are matched with the first mounting holes 7*a*, the second housing 12 and the second lug 7 cannot rotate relative to each other.

As shown in FIG. 1 to FIG. 3 and FIG. 4 to FIG. 8, during assembly, there is no need to fix the first housing 9 and the first lug 3 and fix the second housing 12 and the second lug 7 by using screws or rivets or a welding mode, and it is only necessary to firstly match the second circumferential positioning parts 12*a* with the first mounting holes 7*a*, then match the first assembly holes 3*a* in the first lug 3 with the first circumferential positioning parts 9*a*, and then clamp the first hinged lock C between the first lug 3 and the second lug 7. Therefore, such a structure makes an assembly process simple and convenient.

As shown in FIG. 4 to FIG. 8, a shaft hole is formed in the middle part of the first housing 9. Preferably, the shaft hole is a step hole, and is composed of a first hole 9*b* and a second hole 9*c*, and the inner diameter of the second hole 9*c* is greater than the inner diameter of the first hole 9*b*. A plurality of guide blocks 9*d* positioned around the shaft hole are discretely distributed in the containing cavity D of the first housing 9, and a guide groove 9*e* extending in a radial direction of the first housing 9 is formed between two adjacent guide blocks 9*d*.

As shown in FIG. 4 to FIG. 8, one end of a transmission component E storing and releasing angular energy and connected with the first housing is in clearance fit with the shaft hole. Preferably, the transmission component E is in clearance fit with the first hole 9*b*, and the transmission component E can rotate relative to the first housing 9. The transmission component E includes a transmission shaft 13 and a scroll spring or torsion spring 14. One end of the scroll spring or torsion spring 14 is fixed to the transmission shaft 13, and the other end of the scroll spring or torsion spring 14 is fixed to the first housing 9. Preferably, an inserting hole 9*f* is formed in the first housing 9, one end of the scroll spring or torsion spring 14 is inserted into the inserting hole 9*f* to enable the scroll spring or torsion spring 14 to be connected with the first housing 9, and the scroll spring or torsion spring 14 is positioned in the second hole 9*c*.

As shown in FIG. 4 to FIG. 8, the lock block 10 is in clearance fit in the guide groove 9*e*, and protrusions 10*a* are disposed on the lock block 10. The transmission tray 11 drives the lock block 10 to move in the radial direction of the first housing 9. After the lock block 10 is combined with the second housing 12, the first housing 9 and the second housing 12 are locked. After the lock block 10 is separated from the second housing 12, the locking of the first housing 9 and the second housing 12 is relieved.

As shown in FIG. 4 to FIG. 8, the transmission tray 11 is connected with the other end of the transmission component E. Preferably, the other end of the transmission shaft 13 is polygonal. A polygonal through hole is formed in the transmission tray 11. The other end of the transmission shaft 13 is matched with the through hole to form power transmission in a circumferential direction.

Figure 6:
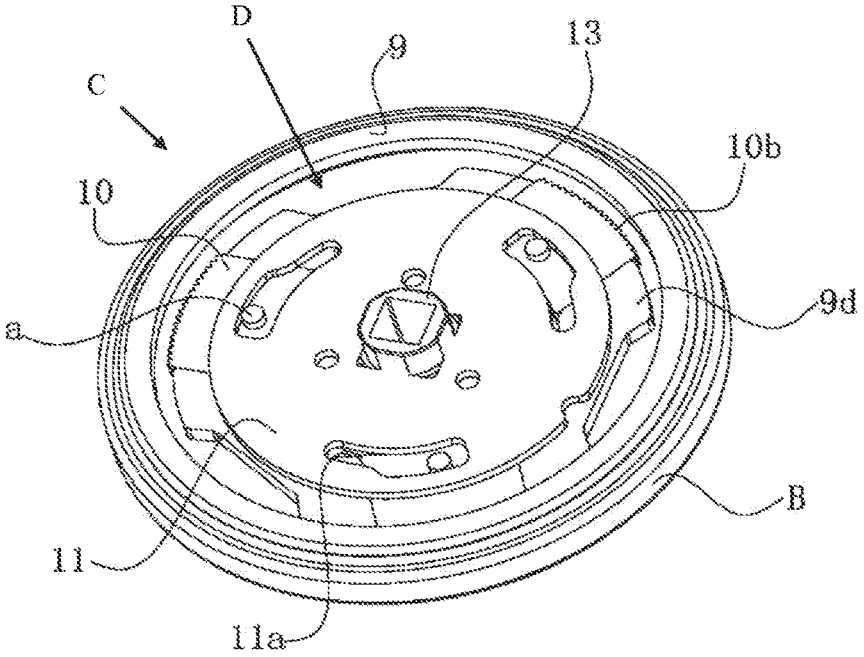
FIG. 6 is a schematic diagram of the first hinged lock after a second housing is hidden.
Figure 7:
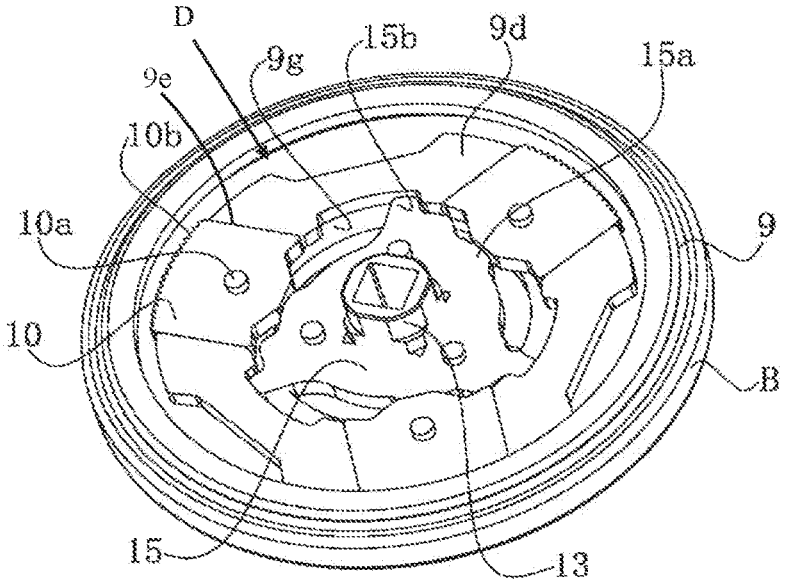
FIG. 7 is a schematic diagram after a transmission tray is hidden on the basis of FIG. 6.
Figure 8:
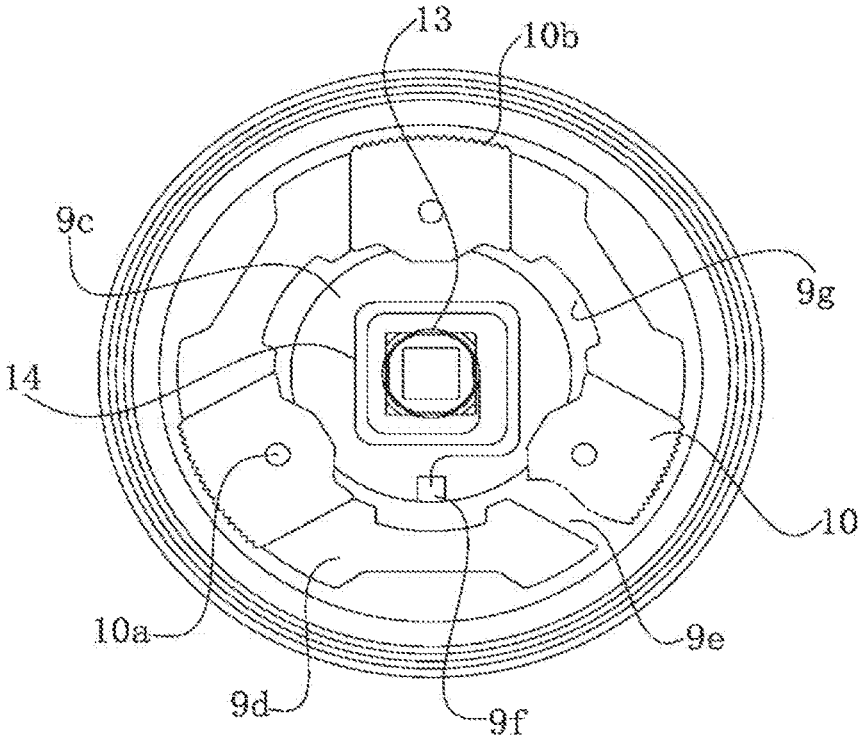
FIG. 8 is a schematic diagram after a star wheel is hidden on the basis of FIG. 7.

A plurality of groove bodies 11*a* are disposed on the transmission tray 11. The width of one end of each groove body 11*a* is less than the width of the other end of each groove body 11*a*. Each groove body 11*a* preferentially adopts a shape as shown in FIG. 6 and may also adopt a structure in which the width of one end gradually narrows toward the other end. The protrusions on the lock block are positioned in the groove bodies 11*a*. When the transmission tray 11 rotates, wall surfaces of the groove bodies 11*a* drive the protrusions 10*a* to drive the lock block 10 to move in the radial direction of the first housing 9.

As shown in FIG. 4 to FIG. 8, one end of the second housing 12 is in clearance fit in the containing cavity D of the first housing 9, and the ring sleeve B is sleeved over the first housing 9 and the second housing 12 in the circumferential direction of the first housing 9 and the second housing 12. The angular energy released by the transmission component E keeps the lock block 10 and the second housing 12 combined through the transmission tray 11 so as to limit the rotation of the first housing 9 and the second housing 12 relative to each other.

As shown in FIG. 4 to FIG. 8, when a torque is applied to the transmission shaft 13, the transmission shaft 13 rotates forward, the transmission shaft 13 drives the transmission tray 11 to rotate forward, the wall surfaces of the groove bodies 11*a* drive the protrusions 10*a* to drive the lock block 10 to move in the radial direction of the first housing 9 to the center of the first housing 9, and the lock block 10 loses a locking effect on the second housing 12, so that the first housing 9 and the second housing 12 can rotate relative to each other. When the transmission shaft 13 rotates forward, the scroll spring or torsion spring 14 elastically deforms, so that the scroll spring or torsion spring 14 stores energy.

As shown in FIG. 4 to FIG. 8, when the torque applied to the transmission shaft 13 is relieved, the scroll spring or torsion spring 14 releases the stored energy to enable the transmission shaft 13 to rotate backward. When the transmission shaft 13 rotates backward, the transmission tray 11 is driven to rotate backward, and the wall surfaces of the groove bodies 11*a* drive the protrusions 10*a* to drive the lock block 10 to move away from the center of the first housing 9 in the radial direction of the first housing 9. Until the lock block 10 and the second housing 12 are combined, the lock block 10 and the second housing 12 form the locking effect again, and at this time, the first housing 9 and the second housing 12 cannot rotate relative to each other.

As shown in FIG. 4 to FIG. 8, preferably, first gear teeth F are disposed on an inner circumferential surface of the second housing 12. Second gear teeth 10*b* are disposed on an end of the lock block 10 matched with the second housing 12. The first gear teeth F are meshed with the second gear teeth 10*b*, so that the lock block 10 and the second housing 12 are combined to form the locking effect on the first housing 9 and the second housing 12.

As shown in FIG. 4 to FIG. 8, preferably, the first hinged lock C further includes a star wheel 15. The transmission component E passes through the star wheel 15, that is, the transmission shaft 13 passes through the star wheel 15. The transmission shaft 13 drives the star wheel 15 to rotate. An abutting part 15*a* for forming an abutting position for the lock block 10 when the lock block 10 and the second housing 12 are kept combined is disposed on a circumferential surface of the star wheel 15.

By virtue of an abutting effect of the abutting part 15*a* on the lock block 10, loosening of combination between the lock block 10 and the second housing is avoided. When the transmission shaft 13 rotates forward, the abutting part 15*a* is separated from the lock block 10, and the circumferential surface of the star wheel 15 is in contact with the lock block 10, so that a space for radial displacement of the lock block 10 is formed between the end of the abutting part 15*a* that abuts against the lock block 10 and the circumferential surface of the star wheel 15.

As shown in FIG. 4 to FIG. 8, first grooves 9*g* are formed in the guide blocks 9*d*, and a blocking part 15*b* matched with the first grooves 9*g* to limit a rotation angle of the star wheel 15 and the transmission component E is further disposed on the circumferential surface of the star wheel 15. Through the matching between the blocking part 15*b* and the first grooves 9*g*, the scroll spring or torsion spring 14 can be prevented from being damaged under the condition that the transmission shaft 13 is excessively rotated.

As shown in FIG. 4 to FIG. 8, by the above structure of the first hinged lock C, when the lock block 10 and the second housing 12 are in a combined state, the first housing 9 and the second housing 12 cannot rotate relative to each other, and the table top and the table leg cannot rotate relative to each other, so that the table top and the table leg cannot form a folded state relative to each other.

After the torque is applied to the transmission shaft 13, the transmission shaft 13 rotates forward, the transmission shaft 13 drives the transmission tray 11 to rotate forward, the wall surfaces of the groove bodies 11*a* drive the protrusions 10*a* to drive the lock block 10 to move in the radial direction of the first housing 9 to the center of the first housing 9, the lock block 10 and the second housing 12 are in a separated state, and the lock block 10 loses the locking effect on the second housing 12, so that the first housing 9 and the second housing 12 can rotate relative to each other, and the table top and the table leg forms the folded state relative to each other. Since the lock block 10 and the second housing 12 are matched by means of gear teeth or friction components, when the table top and the table leg form the folded state relative to each other, the included angle formed between the table top and the table leg is 0 to 90°.

Figure 9:
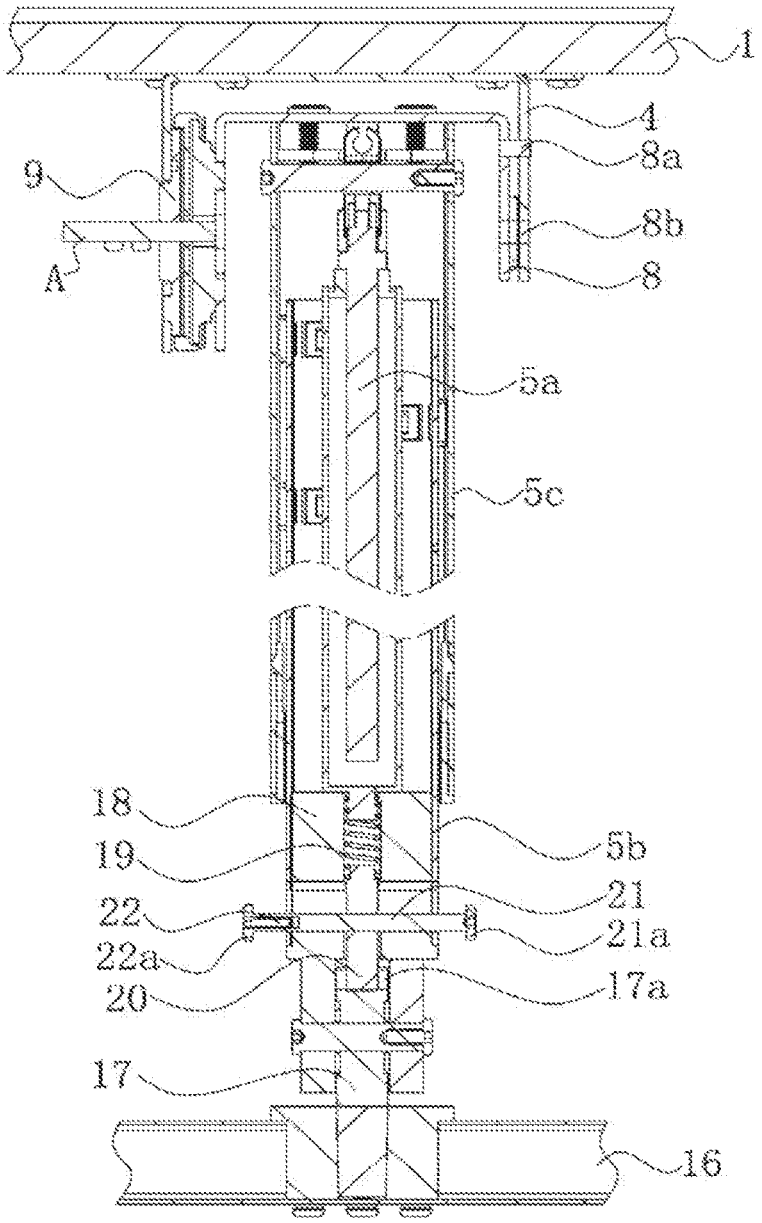
FIG. 9 is a cross-sectional diagram of FIG. 1.

As shown in FIG. 1 and FIG. 9, the folding table in the present embodiment further includes a grounded part 16 supported on the ground or a platform, and a second hinged lock for locking the table leg and the grounded part 16 after the table leg and the grounded part 16 rotate relative to each other. One end of the second hinged lock is connected with the other end of the table leg, and the other end of the second hinged lock is connected with the grounded part. After the table leg or the grounded part rotates relative to each other in an unlocked state, the second hinged lock locks the table leg and the grounded part at an included angle of one of 0 to 90°.

Figure 10:
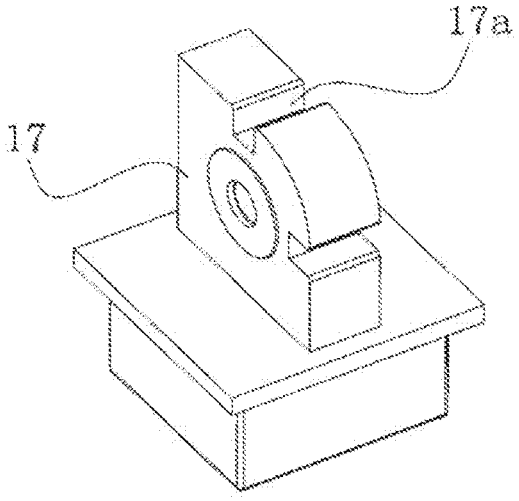
FIG. 10 is a schematic diagram of a first connecting base.
Figure 11:
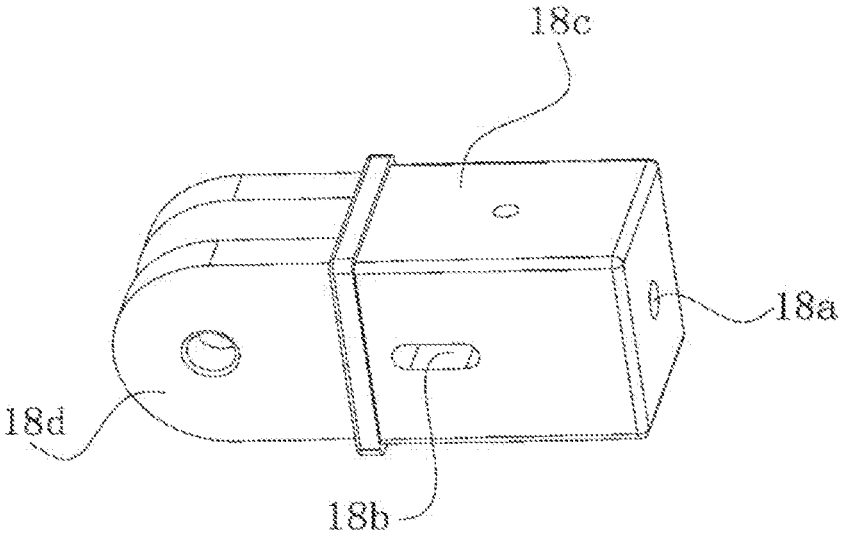
FIG. 11 is a schematic diagram of a second connecting base.
Figure 12:
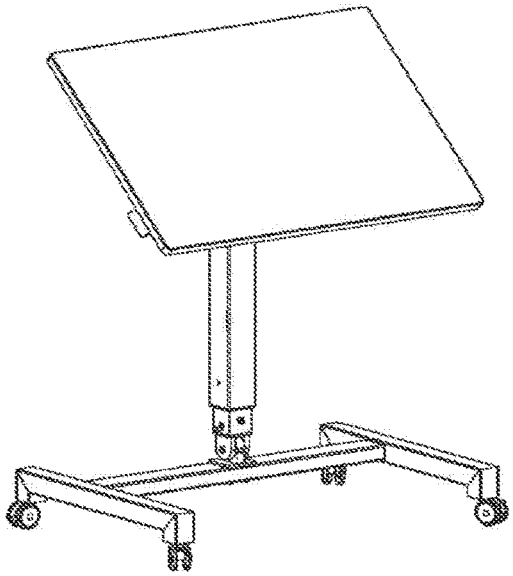
FIG. 12 is a schematic diagram when the included angle between the table top and the table leg is locked at 45° after folding.
Figure 13:
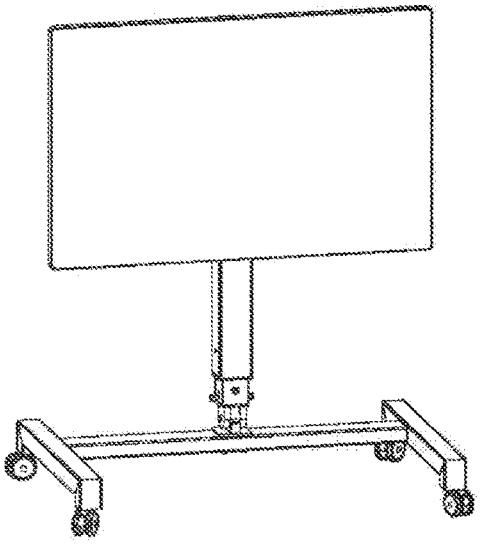
FIG. 13 is a schematic diagram when the included angle between the table top and the table leg is locked at 0° after folding.
Figure 14:
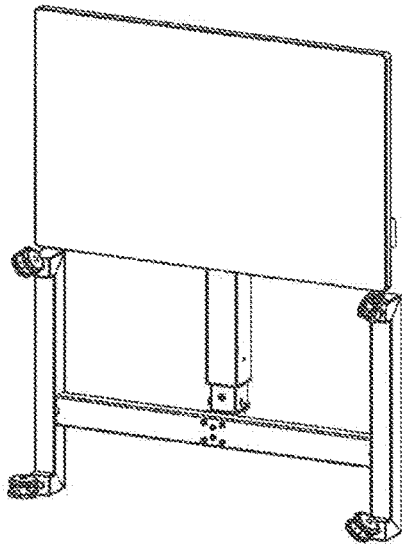
FIG. 14 is a schematic diagram when the included angle between the table leg and the grounded part is locked at 0° on the basis of FIG. 13.

As shown in FIG. 9 to FIG. 11, preferably, after the second hinged lock locks the table leg and the grounded part at an included angle of one of 0 to 90°, and then the second hinged lock keeps the connection with the table leg, and the second hinged lock keeps the connection with the grounded part 16 so as to limit the rotation of the table leg and the grounded part 16 relative to each other.

As shown in FIG. 9 to FIG. 11, the second hinged lock includes a first connecting base 17 fixed to the grounded part 16, and a lockset. The first connecting base 17 is fixed integrally with the grounded part 16 preferentially by screws. The preferred structure used by the grounded part 16 is composed of a support part and wheels. The wheels are connected with the support part. The whole grounded part 16 of this structure can move. The structure of the second hinged lock is described below.

As shown in FIG. 9 to FIG. 11, at least two grooves 17*a* are formed in a circumferential surface of the first connecting base 17, and the number of the grooves 17*a* can be set according to needs, such as three or four or more. One end of the lockset is fixed to the table leg, and the other end of the lockset is hinged with the first connecting base 17. When the lockset is combined with any one of the grooves 17*a* in the first connecting base 17, the table leg and the grounded part 16 cannot rotate relative to each other. When the lockset is separated from any one of the grooves 17*a* in the first connecting base 17, the table leg and the grounded part 16 can rotate relative to each other.

As shown in FIG. 9 to FIG. 11, the lockset includes a second connecting base 18, an elastic component 19, a tongue part 20 and a transmission mechanism. The second connecting base 18 is hinged with the first connecting base 17. A first assembly hole 18*a* extending axially along the second connecting base 18 is formed in the second connecting base 18. A second assembly hole 18*b* extending transversely along the second connecting base is formed in the second connecting base 18. Both the first assembly hole 18*a* and the second assembly hole 18*b* are through holes.

As shown in FIG. 9 to FIG. 11, the elastic component 19 is positioned in the first assembly hole 18*a*. The elastic component 19 preferentially uses a spring. One end of the elastic component 19 is limited by the second connecting base 18 or the table leg body 5. When the first assembly hole 18*a* is a step hole, the elastic component 19 is limited by a step of the first assembly hole. When an end part of the table leg body 5 is inserted into the first assembly hole 18*a*, the elastic component 19 can be limited at the end part of the table leg body 5.

As shown in FIG. 9 to FIG. 11, one end of the tongue part 20 is positioned in the first assembly hole 18*a* and is connected with the elastic component 19, and the other end of the tongue part 20 is a free end combined with or separated from the groove 17*a*. When the tongue part 20 is inserted into the groove 17*a*, the tongue part 20 forms a locking effect on the first connecting base 17 and the second connecting base 18, and thus, the first connecting base 17 and the second connecting base 18 cannot rotate relative to each other. After the tongue part 20 completely retreats from the groove 17*a*, the locking of the first connecting base 17 and the second connecting base 18 is relieved, and thus, the first connecting base 17 and the second connecting base 18 can rotate relative to each other.

As shown in FIG. 9 to FIG. 11, the transmission mechanism displaces the tongue part 20 axially along the first assembly hole. A part of the transmission mechanism is matched with the tongue part 20 after passing through the second assembly hole 18*b*. The other part of the transmission mechanism is exposed to the air. The height of the transmission mechanism is less than the height of the second assembly hole 18*b*.

As shown in FIG. 9 to FIG. 11, the transmission mechanism is a manual transmission mechanism. The manual transmission mechanism includes a rod part 21. The second assembly hole 18*b* is a waist-shaped hole or rectangular hole, and therefore, the height or outer diameter of the rod part 21 is less than the height of the second assembly hole. At least one end of the rod part 21 is exposed to the air. One end of the rod part 21 is exposed to the air after passing through the second assembly hole 18*b* and the tongue part. The other end of the rod part 21 is also exposed to the air.

As shown in FIG. 9 to FIG. 11, when the thumb and the index finger clamp two ends of the rod part 21 and push the rod part 21 to compress the elastic component 19, the rod part 21 drives the tongue part 20 to be displaced axially along the first assembly hole 18*a* so as to separate the tongue part 20 from the groove 17*a*, and the table leg and the grounded part 16 can rotate relative to each other, so that the grounded part 16 is folded between 0 and 90° relative to the table leg.

As shown in FIG. 9 to FIG. 11, one end of the rod part 21 is provided with a mounting hole, and the other end of the rod part 21 is provided with a first flange 21*a* for increasing a contact area. The manual transmission mechanism further includes a connecting component 22. One end of the connecting component 22 is inserted into the mounting hole in the rod part 21 and fixed to the rod part 21, and the other end of the connecting component 22 is provided with a second flange 22*a* for increasing a contact area. Preferably, the mounting hole in the rod part 21 is a threaded hole, and the connecting component 22 is a bolt.

As shown in FIG. 9 to FIG. 11, the second connecting base 18 includes a fixed part 18*c* connected with the table leg and two hinged parts 18*d* hinged with the first connecting base 17. Both the first assembly hole 18*a* and the second assembly hole 18*b* are formed in the fixed part 18*c*. The two hinged parts 18*d* are disposed at one end of the fixed part. A part of the tongue part 20 is positioned between the two hinged parts 18*d*.

As shown in FIG. 9 to FIG. 11, preferably, the table leg body 5 includes a lifting air pressure bar 5*a*, an inner sleeve 5*b* and an outer sleeve 5*c*. One end of the lifting air pressure bar 5*a* is fixedly connected with the second hinged lock. One end of the lifting air pressure bar 5*a* is fixedly connected with the second connecting base 18. A part of the lifting air pressure bar 5*a* is positioned in the inner sleeve 5*b*. The other end of the lifting air pressure bar 5*a* is fixed to one end of the outer sleeve 5*c* or the second bracket.

As shown in FIG. 9 to FIG. 11, one end of the inner sleeve 5*b* is fixedly connected with the second hinged lock. The inner sleeve 5*b* is sleeved over the fixed part 18*c* and then is fastened with the fixed part 18*c*. Preferably, the inner sleeve 5*b* is in interference fit with the fixed part 18*c*. A side surface of the inner sleeve 5*b* is provided with an avoiding hole 5*d*, so that the end of the rod part 21 can pass through the avoiding hole 5*d*. The avoiding hole 5*d* is a waist-shaped hole or rectangular hole. The outer sleeve 5*c* is sleeved over the inner sleeve 5*b*, and the outer sleeve 5*c* is in clearance fit with the inner sleeve 5*b*. One end of the outer sleeve 5*c* is fixed to the other end of the lifting air pressure bar 5*a* or the second bracket. Preferably, one end of the outer sleeve 5*c* is fixed to the second top 6, and the outer sleeve 5*c* moves up and down as the lifting air pressure bar 5*a* moves up and down.

As shown in FIG. 9 to FIG. 11, through the matching between the inner sleeve 5*b* and the outer sleeve 5*c*, the lifting air pressure bar 5*a* is blocked. When the lifting air pressure bar 5*a* drives the table top to move up and down, an action of the lifting air pressure bar 5*a* cannot be observed, thereby being favorable for improving the aesthetics of the folding table when in use.

The structure of the folding table of the present invention is not limited to the above embodiments, for example:

(a) For the first hinged lock C, the combination of the lock block 10 and the second housing 12 is not limited to the above gear tooth matching mode, and may also adopt: a first friction component is disposed on the inner circumferential surface of the second housing 12, a second friction component is disposed on the end of the lock block 10 matched with the second housing 12, both the first friction component and the second friction component are made of materials with a high friction coefficient, and the friction coefficient of the first friction component and the second friction component may also be increased by increasing a surface roughness. Through a matching action force between the first friction component and the second friction component, the first housing 9 and the second housing 12 cannot rotate relative to each other.

Figure 15:
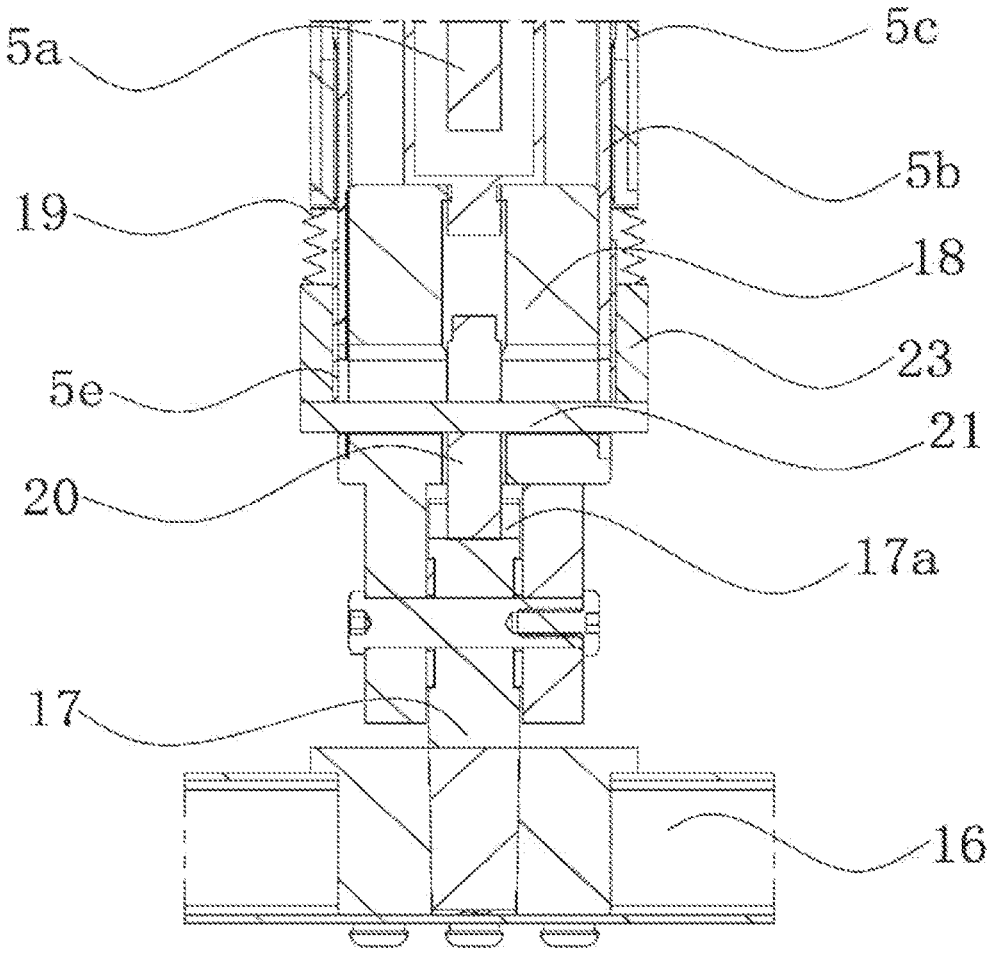
FIG. 15 is a schematic diagram of a second embodiment of a second hinged lock.

(b) For the second hinged lock, the lockset may adopt the following structure:

As shown in FIG. 15, the lockset includes a second connecting base 18, a tongue part 20 and a driving device. At least two grooves 17*a* are formed in a circumferential surface of a first connecting base 17, and the second connecting base 18 is hinged with the first connecting base 17. A first assembly hole 18*a* extending axially along the second connecting base is formed in the second connecting base 18. A second assembly hole 18*b* extending transversely along the second connecting base is formed in the second connecting base 18. One end of the tongue part 20 is positioned in the first assembly hole 18*a*, and the other end of the tongue part 20 is a free end combined with or separated from the grooves 17*a*.

As shown in FIG. 15, the driving device displaces the tongue part 20 axially along the first assembly hole 18*a*. The driving device includes a transmission mechanism and a driving mechanism. The driving mechanism is fixed on the second connecting base 18 or the table leg. An output end of the driving mechanism is connected with one end of the transmission mechanism. The other end of the transmission mechanism is matched with the tongue part 20 after passing through the second assembly hole 18*b*. The height of the transmission mechanism is less than the height of the second assembly hole 18*b*. The transmission mechanism adopts a rod part 21 preferentially. The second assembly hole 18*b* is a waist-shaped hole or rectangular hole, and therefore, the height or outer diameter of the rod part 21 is less than the height of the second assembly hole 18*b*.

As shown in FIG. 15, the driving mechanism includes a slide block 23 in slide fit with the second connecting base 18 or the table leg, and an elastic component 19. The slide block 23 is exposed to the air. One end of the slide block 23 is connected with the transmission mechanism, and the transmission mechanism is the rod part 21, that is, one end of the slide block 23 is connected with the rod part 21. One end of the elastic component 19 is connected with the other end of the slide block 23, and the other end of the elastic component 19 is connected with the second connecting base 18 or the table leg.

As shown in FIG. 15, in the present embodiment, a slide rail 5*e* is disposed on an outer wall of an inner sleeve 5*b*. The slide block 23 is in slide fit with the slide rail 5*e* on the inner sleeve 5*b*, and the other end of the elastic component 19 is connected with the inner sleeve 5*b*.

When in use, the thumb and the index finger clamp the slide block 23 and push the slide block 23 to compress the elastic component 19, the rod part 21 drives the tongue part 20 to be displaced axially along the first assembly hole 18*a* so as to separate the tongue part 20 from the grooves 17*a*, and the table leg and the grounded part 16 can rotate relative to each other, so that the grounded part 16 is folded between 0 and 90° relative to the table leg.

Figure 16:
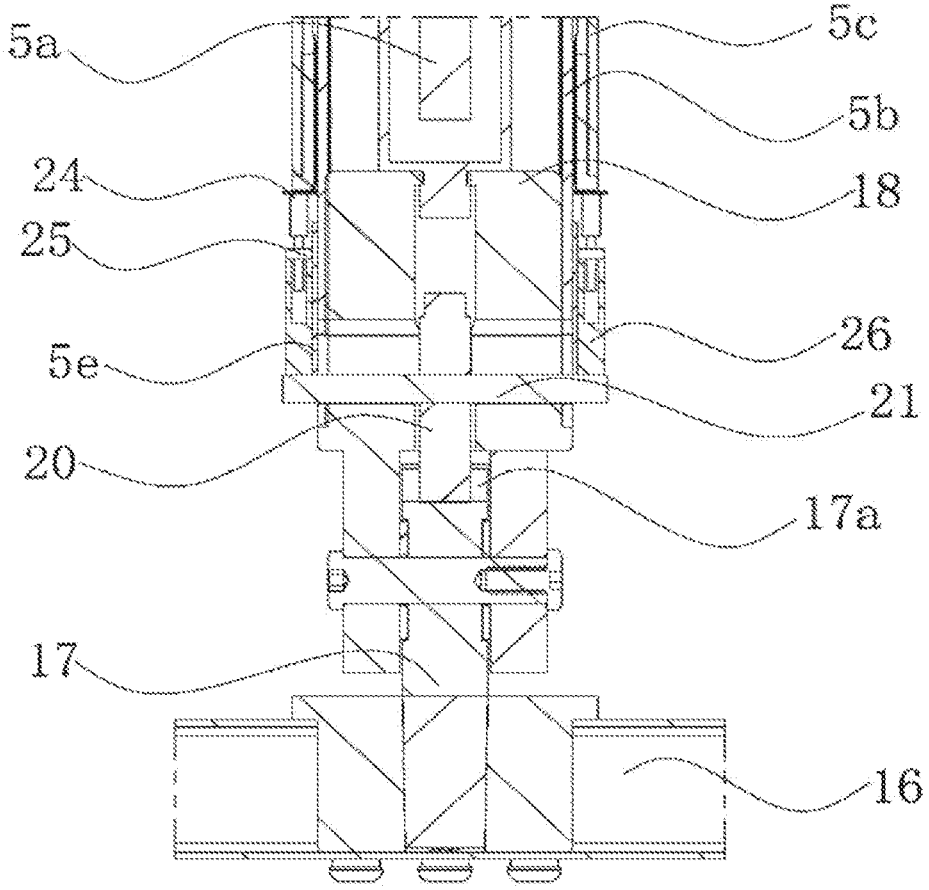
FIG. 16 is a schematic diagram of a third embodiment of the second hinged lock.

(c) The structure of the driving mechanism in the above embodiment (b) adopts a manual driving mode. As shown in FIG. 16, the driving mechanism may also adopt an electric linear driving mechanism. The electric linear driving mechanism includes an electric motor 24, a first linear transmission component 25 and a second linear transmission component 26. Threads are formed on an output shaft of the electric motor 24. The first linear transmission component 25 is sleeved over the output shaft of the electric motor 24 and is in threaded connection with the output shaft. A groove body is disposed on a circumferential surface of the first linear transmission component 25. A slide rail 5*e* parallel to the axial direction of the table leg is disposed on a second connecting base 18 or the table leg. The groove body is in clearance fit with the slide rail 5*e*. Through the matching between the groove body and the slide rail 5*e*, the rotation of the first linear transmission component 25 can be prevented, and when the first linear transmission component 25 moves, the first linear transmission component 25 is guided. One end of the second linear transmission component 26 is connected with the transmission mechanism, and the other end of the second linear transmission component 26 is connected with the first linear transmission component 25. The transmission mechanism is a rod part 21, that is, one end of the second linear transmission component 26 is connected with the rod part 21.

As shown in FIG. 16, when in use, the electric motor 24 is controlled to rotate forward. The output shaft of the electric motor 24 rotates forward to drive the first linear transmission component 25 to move linearly along the slide rail 5*e* in the direction of the table top (upward). The first linear transmission component 25 drives the second linear transmission component 26 to drive the rod part 21 to move upward so as to separate the tongue part 20 from the groove 17*a*, and the table leg and the grounded part 16 can rotate relative to each other, so that the grounded part 16 is folded between 0 and 90° relative to the table leg. After folding to a required angle, the electric motor 24 is controlled to rotate backward, and the driving mechanism drives the tongue part 20 to be inserted into the groove 17*a* of a corresponding angle, so that the first connecting base 17 and the second connecting base 18 are locked.

(d) The first hinged lock C for connecting the table top with the table leg may also adopt the structure of the above second hinged lock.

(e) The second hinged lock for connecting the table leg with the grounded part 16 may also adopt the structure of the first hinged lock C.

Figure 17:
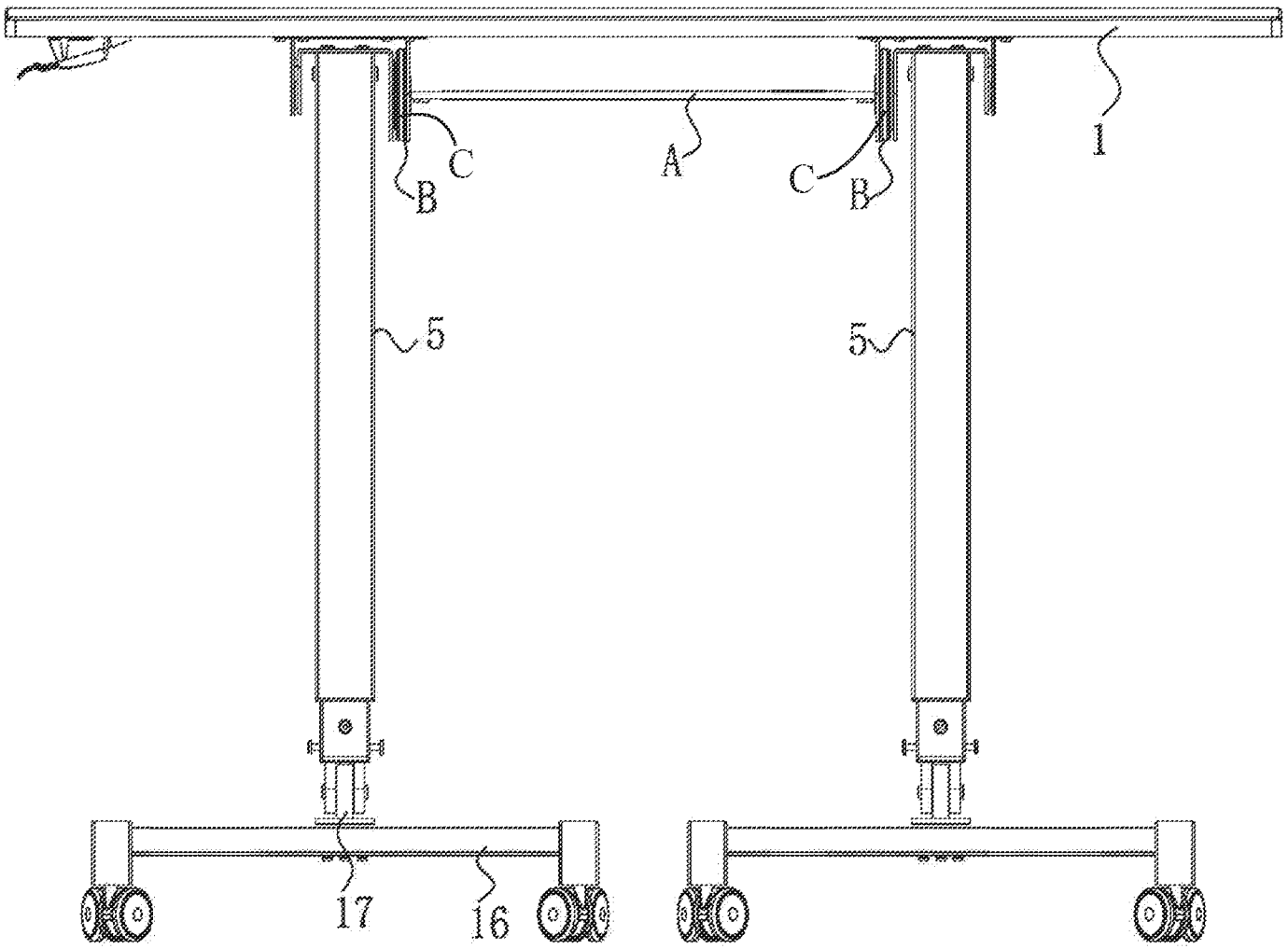
FIG. 17 is a schematic diagram of a folding table with two table legs.

(f) The folding table as shown in FIG. 1 is of a single-table-leg structure, and the folding table may also have two table legs. The connection mode between each table leg and the table top, and the connection mode between each table leg and each grounded part 16 are the same as those in any one of the above embodiments. As shown in FIG. 17, the connection mode in the present embodiment is the same as that in embodiment I. Two first hinged locks C are connected through a handle A, and the handle A is composed of a handle body and a shaft. When the shaft is rotated by the handle body, the locking of the two first hinged locks C on the table top and the table legs can be relieved simultaneously. After an included angle between the table top and the table leg is adjusted, the handle A is released, and the first hinged lock C is reset under the action of a scroll spring or torsion spring 14 so as to lock the table top and the table leg after the included angle is adjusted.

Figure 18:
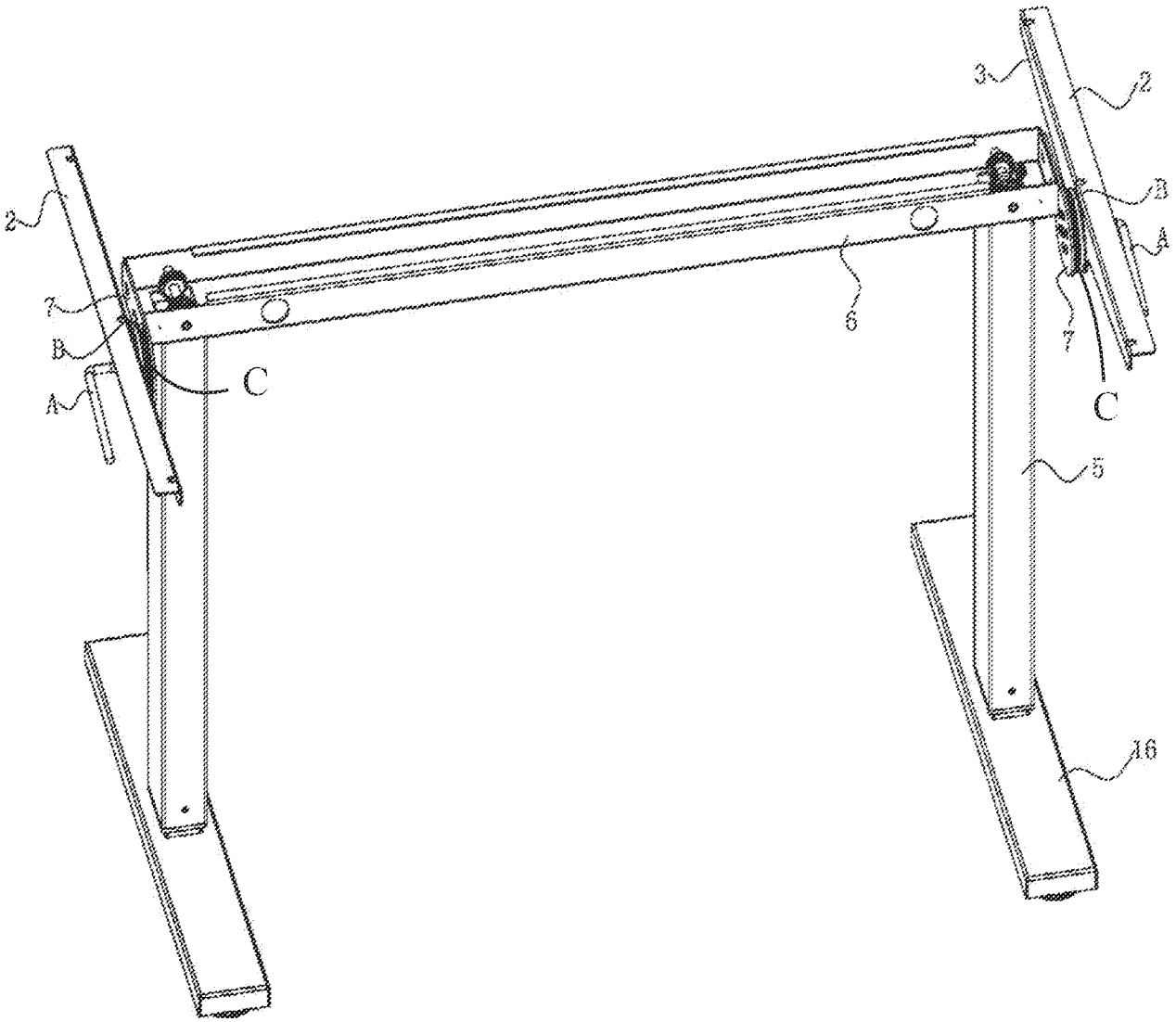
FIG. 18 is a schematic diagram of another folding table with two table legs (a table top body is hidden).

(g) The two table legs in the (f) may also adopt a structure as shown in FIG. 18. For a folding table with this structure, a first hinged lock C is disposed between a table top and the table leg, so that the table top can be folded relative to the table leg through the first hinged lock C, and a second hinged lock is not disposed between the table leg and the grounded part 16, so that the grounded part 16 cannot be folded relative to the table leg. Furthermore, the differences between the structures of a first bracket and a second bracket and those in the above embodiment I are as follows: the first bracket is composed of a first top 2 and a first lug 3, and the second bracket is composed of a second top 6 and a third lug 7. The second top 6 is a cross beam, and the second top 6 is connected with the table leg and supports a table top body 1. The second top 6 is fixedly connected with the third lug 7 through screws. A second hinged lock is respectively mounted at one end of the second bracket, and each second hinged lock is connected with a handle A. Or, it is also possible to adopt one handle A as in the mode (f), the handle A is composed of a handle body and a shaft. The shaft is connected with the handle body, and the shaft is also connected with the two second hinged locks respectively. When the shaft is rotated by the handle body, the locking of the two first hinged locks C on the table top and the table legs can be relieved simultaneously.

(h) The cross sections of an inner sleeve 5*b* and an outer sleeve 5*c* may be square or round.

What is claimed is:

1. A folding table, comprising:

a table top;

a table leg; and a first hinged lock for locking the table leg and the table top after the table leg and the table top rotate relative to each other, wherein one end of the first hinged lock is connected with the table top, and an other end of the first hinged lock is connected with the table leg; and the table leg or the table top rotates relative to each other in an unlocked state, the first hinged lock locks the table leg and the table top at an included angle of one of 0 to 90°, and then one end of the first hinged lock keeps a connection with the table top, and an other end of the first hinged lock keeps a connection with the table leg so as to limit a rotation of the table top and the table leg relative to each other;

wherein the first hinged lock comprises:

a first housing with a containing cavity, wherein a shaft hole is formed in a middle part of the first housing, a plurality of guide blocks positioned around the shaft hole are discretely distributed in the containing cavity of the first housing, and a guide groove extending in a radial direction of the first housing is formed between two adjacent guide blocks of the plurality of guide blocks;

a transmission component connected with the first housing, wherein one end of the transmission component is in clearance fit with the shaft hole;

a lock block in clearance fit in the guide groove, wherein protrusions are disposed on the lock block;

a transmission tray for driving the lock block to move in the radial direction of the first housing, wherein the transmission tray is connected with an other end of the transmission component, a plurality of groove bodies are disposed on the transmission tray, a width of one end of each groove body of the plurality of groove bodes is less than a width of an other end of each groove body of the plurality groove bodies, and the protrusions on the lock block are positioned in the plurality of groove bodies; and a second housing, wherein one end of the second housing is in clearance fit in the containing cavity of the first housing.

2. The folding table according to claim 1, wherein the table top comprises:

a table top body; and a first bracket, wherein the first bracket comprises:

a first top fixed to the table top body; and a first lug connected with the one end of the first hinged lock, wherein the first lug is disposed at one end of the first top.

3. The folding table according to claim 2, wherein the first bracket further comprises:

a second lug hinged with the table leg, wherein the second lug is disposed at an other end of the first top.

4. The folding table according to claim 1, wherein the table leg comprises:

a table leg body; and a second bracket, wherein the second bracket comprises:

a second top fixed to the table leg body; and a third lug connected with the other end of the first hinged lock, wherein the third lug is disposed at one end of the second top.

5. The folding table according to claim 4, wherein the second bracket further comprises:

a fourth lug hinged with the table top, wherein the fourth lug is disposed at an other end of the second top.

6. The folding table according to claim 1, wherein the transmission component comprises:

a transmission shaft; and a scroll spring or torsion spring, wherein one end of the scroll spring or torsion spring is fixed to the transmission shaft, and an other end of the scroll spring or torsion spring is fixed to the first housing.

7. The folding table according to claim 6, wherein the first hinged lock further comprises a star wheel, the transmission component passes through the star wheel.

8. The folding table according to claim 1, wherein first gear teeth are disposed on an inner circumferential surface of the second housing, second gear teeth are disposed at an end of the lock block matched with the second housing, and the first gear teeth are meshed with the second gear teeth.

9. The folding table according to claim 8, wherein the first hinged lock further comprises a star wheel, the transmission component passes through the star wheel.

10. The folding table according to claim 1, wherein the first hinged lock further comprises a star wheel, the transmission component passes through the star wheel.

11. The folding table according to claim 10, wherein first grooves are formed in the plurality of guide blocks, and a blocking part matched with the first grooves to limit a rotation angle of the star wheel and the transmission component is further disposed on the circumferential surface of the star wheel.

* * * * *